US006155059A

United States Patent [19]

Matté et al.

[11] Patent Number: 6,155,059

[45] Date of Patent: Dec. 5, 2000

[54] HIGH CAPACITY CRYOPUMP

[75] Inventors: Stephen R. Matté, Norfolk; Allen J. Bartlett, Mendon, both of Mass.

[73] Assignee: Helix Technology Corporation, Mansfield, Mass.

[21] Appl. No.: 09/229,721

[22] Filed: Jan. 13, 1999

[51] Int. Cl.[7] ..... B01D 8/00

[52] U.S. Cl. ..... 62/55.5

[58] Field of Search ..... 62/55.5; 55/DIG. 15; 417/901

[56] References Cited

U.S. PATENT DOCUMENTS

| | | | |
|---|---|---|---|
| 3,122,896 | 3/1964 | Hickey | 62/259 |
| 3,338,063 | 8/1967 | Hogan et al. | 62/55.5 |
| 3,579,997 | 5/1971 | Rapinat | 62/55.5 |
| 3,579,998 | 5/1971 | Thibault et al. | 62/55.5 |
| 3,635,039 | 1/1972 | Power et al. | 62/55.5 |
| 3,785,162 | 1/1974 | Long et al. | 62/55.5 |
| 4,148,196 | 4/1979 | French et al. | 62/55.5 |
| 4,212,170 | 7/1980 | Winkler | 62/55.5 |
| 4,277,951 | 7/1981 | Longsworth | 62/55.5 |
| 4,285,710 | 8/1981 | Welch | 62/40 |
| 4,466,252 | 8/1984 | Hood | 62/55.5 |
| 4,530,213 | 7/1985 | Kadi | 62/55.5 |
| 4,541,249 | 9/1985 | Graves et al. | 62/55.5 |
| 4,555,907 | 12/1985 | Bartlett | 62/55.5 |
| 4,577,465 | 3/1986 | Olsen et al. | 62/55.5 |
| 4,607,493 | 8/1986 | Sukenobu | 62/55.5 |
| 4,614,093 | 9/1986 | Bachler et al. | 62/55.5 |
| 4,718,241 | 1/1988 | Lessard et al. | 62/55.5 |
| 4,736,591 | 4/1988 | Amos et al. | 62/55.5 |
| 4,803,844 | 2/1989 | Bartlett | 62/55.5 |
| 5,083,445 | 1/1992 | Saho et al. | 62/55.5 |
| 5,228,299 | 7/1993 | Harrington et al. | 62/55.5 |
| 5,261,244 | 11/1993 | Lessard et al. | 62/55.5 |
| 5,301,511 | 4/1994 | Bartlett et al. | 62/55.5 |
| 5,305,612 | 4/1994 | Higham et al. | 62/55.5 |
| 5,425,584 | 6/1995 | Ide | 384/99 |
| 5,447,033 | 9/1995 | Nagao et al. | 62/6 |
| 5,483,803 | 1/1996 | Matté et al. | 62/55.5 |
| 5,542,257 | 8/1996 | Mattern-Klosson et al. | 62/55.5 |
| 5,782,096 | 7/1998 | Bartlett et al. | 62/55.5 |

FOREIGN PATENT DOCUMENTS

| | | |
|---|---|---|
| 0 117 523 | 2/1984 | European Pat. Off. . |
| 28 30 943 | 1/1980 | Germany . |
| 8804218 | 5/1988 | Germany . |
| 60-88881 | 5/1985 | Japan . |
| 61038179 | 2/1986 | Japan . |

OTHER PUBLICATIONS

"AP–8S Cryopump—Setting New Standards For Operational Reliability," 4 pages, brochure by Air Products and Chemicals, Inc. (1983).

*Primary Examiner*—William Doerrler

*Attorney, Agent, or Firm*—Hamilton, Brook, Smith & Reynolds, PC

[57] ABSTRACT

A cryopump including a radiation shield having an interior surrounded by at least one wall. The radiation shield has an opening through which gases are cryopumped into the interior. A frontal cryopanel array is positioned near the opening for condensing high boiling point gases. The radiation shield and frontal cryopanel array are cooled to a first temperature. First primary cryopanel surfaces extend near the wall within the interior of the radiation shield and are cooled to a second temperature below the first temperature for condensing low boiling point gases near the wall while leaving a central gas flow pathway from the opening past the first primary cryopanel surfaces. Second primary cryopanel surfaces cooled to about the second temperature are positioned within the interior of the radiation shield and include adsorbent for adsorbing very low boiling point gases. The first primary cryopanel surfaces limit the amount of low boiling point gases condensing on the second primary cryopanel surfaces while leaving open the central gas flow pathway to the second primary cryopanel surfaces.

28 Claims, 5 Drawing Sheets

HIGH CAPACITY CRYOPUMP

BACKGROUND OF THE INVENTION

Cryopumps are typically cooled by either open or closed cryogenic cycles and generally follow the same design concept. A low temperature second stage primary cryopanel array, usually operating in the range of 4 to 25 K is the primary pumping surface. This surface is centrally located within a higher temperature housing, usually operated in the temperature range of 60 to 140 K, which provides radiation shielding to the lower temperature primary cryopanel array. The radiation shield is generally closed except at a first stage frontal array positioned between the primary cryopanel array and the process chamber to be evacuated. This higher temperature frontal array serves as a pumping site for higher boiling point gases such as water vapor.

In operation, high boiling point gases such as water vapor are condensed on the frontal array. Lower boiling point gases pass through that array into the interior of the radiation shield and condense on the primary cryopanel array. A surface coated with an adsorbent such as charcoal or a molecular sieve operating at or below the temperature of the primary cryopanel array may also be provided within the radiation shield to remove the very low boiling point gases such as hydrogen. To prevent overloading of the adsorbent, the adsorbent is generally provided on surfaces which are protected by the primary cryopanel array. By condensing or adsorbing gases onto the pumping surfaces, only a vacuum remains in the process chamber.

In cryopumps where the radiation shield fits closely about the primary cryopanel array, there is limited space between the radiation shield and the primary cryopanel array. In cryopumps of this design, there is a tendency for lower boiling point gases such as argon to condense heavily on the surfaces of the primary cryopanel array closest to the opening through which gases are cryopumped. When this occurs, frost from these condensing gases significantly narrows the gap between the radiation shield and the primary cryopanel array, limiting the ability of other gases to reach the condensing surfaces on the primary cryopanel array further away from the opening as well as the surfaces coated with adsorbent material. A significantly narrowed gap between the radiation shield and the primary cryopanel array greatly reduces the pumping speed of the cryopump.

SUMMARY OF THE INVENTION

The present invention is directed to a cryopump in which the pumping speed or capacity of the cryopump remains relatively high during operation. The cryopump includes a radiation shield, the shield having an interior surrounded by at least one wall. The radiation shield has an opening through which gases are cryopumped into the interior. A frontal cryopanel array is positioned near the opening for condensing high boiling point gases. The radiation shield and frontal cryopanel array are cooled to a first temperature. First primary cryopanel surfaces extending near the shield wall within its interior are cooled to a second temperature below the first temperature for condensing low boiling point gases such as argon near the wall while leaving a central gas flow pathway from the opening past the first primary cryopanel surfaces. Second primary cryopanel surfaces cooled to about the second temperature are positioned within the interior of the radiation shield and include adsorbent for adsorbing very low boiling point gases such as hydrogen. The first primary cryopanel surfaces limit the amount of low boiling point gases condensing on the second primary cryopanel surfaces while at the same time leaving open the central gas flow pathway to the second primary cryopanel surfaces.

In preferred embodiments, the radiation shield, frontal cryopanel array, and the first and second primary cryopanel surfaces are enclosed within a vacuum vessel. The first and second cryopanel surfaces are conductively coupled together with the first primary cryopanel surfaces substantially surrounding the second primary cryopanel surfaces. The second primary cryopanel surfaces include panels which are angled away from the opening and include adsorbent on the lower surfaces of the panels facing away from the opening. The frontal cryopanel array and the radiation shield are preferably cooled to about 60 K to 140 K and the first and second primary cryopanel surfaces are preferably cooled to less than about 25 K.

In other preferred embodiments, the first primary cryopanel surfaces are formed from a cylindrically shaped panel. In some embodiments, the cylindrically shaped panel can be cup-shaped. Additionally, in some embodiments, the second primary cryopanel surfaces include a frusto-conical shaped panel while in other embodiments, the second primary cryopanel surfaces are annularly shaped panels secured to the cylindrically shaped panel.

By extending the first primary cryopanel surfaces near the wall within the interior of the vacuum vessel, a large central gas flow pathway is left open which allows gases to flow freely to the second primary cryopanel surfaces. In addition, by limiting the amount of low boiling point gases condensing on the second primary cryopanel surfaces, very low boiling point gases such as hydrogen have relatively unrestricted access to the adsorbent and can be more quickly adsorbed, thereby maintaining a high hydrogen pumping speed.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
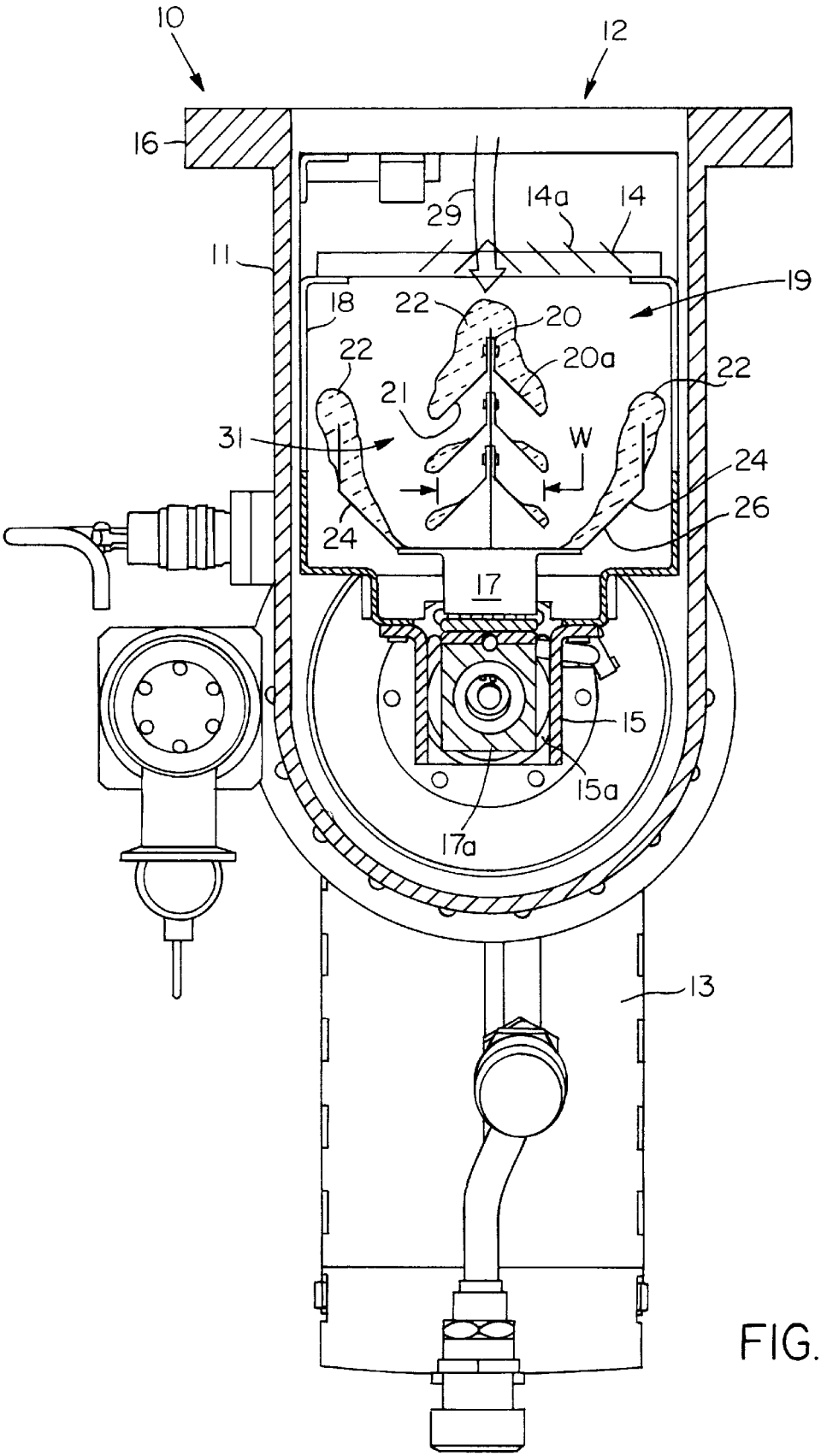
FIG. 1 is a side-sectional view of the present invention cryopump.
Figure 2:
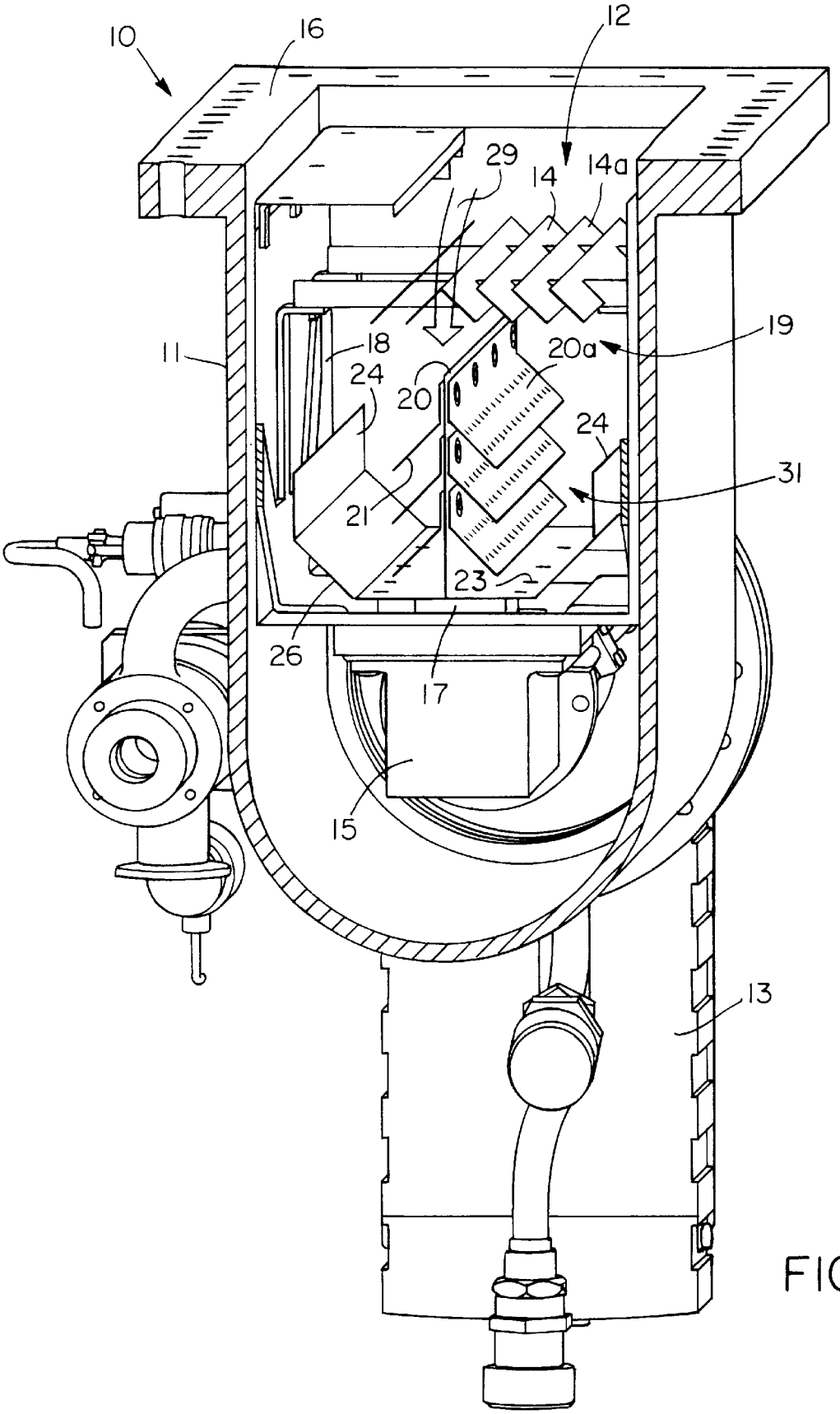
FIG. 2 is a perspective sectional view of the present invention cryopump.
Figure 3:
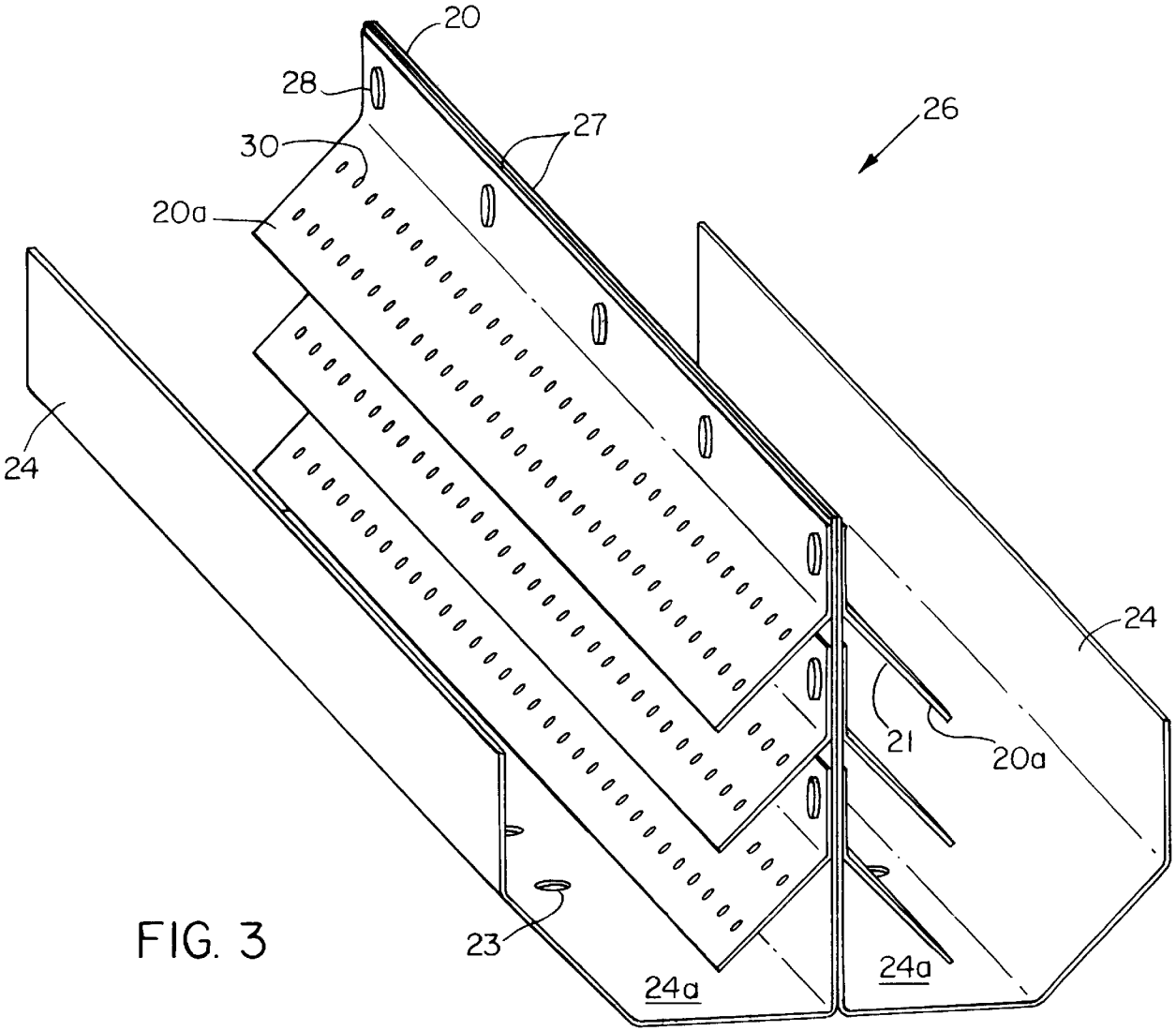
FIG. 3 is a perspective view of the primary cryopanel array of the present invention cryopump.

Referring to FIGS. 1–3, cryopump 10 includes a vacuum vessel 11 having a flange 16 for mounting the vacuum vessel 11 in communication with a process chamber. An opening 12 to the vacuum vessel 11 extends through flange 16, thereby allowing the gases from the process chamber to enter the interior 19 of vacuum vessel 11. Typically, a gate valve is positioned between the flange 16 of cryopump 10 and the process chamber 11 for bringing the process chamber in and out of communication with vacuum vessel 11. Cryopump 10 also includes a cryogenic refrigerator 13 which is mounted to vacuum vessel 11. Refrigerator 13 has a first cold finger 15*a* and a second cold finger 17*a* extending into the interior of vacuum vessel 11. The first cold finger 15*a* and the second cold finger 17*a* are thermally coupled to a first thermal strut 15 and a second thermal strut 17, respectively. Thermal struts 15 and 17 provide right angled thermal coupling to cold fingers 15*a*/17*a*. Thermal strut 15 is conductively coupled to a radiation shield 18 positioned within the interior 19 of vacuum vessel 11 as well as a first stage or frontal cryopanel array 14 which is mounted to radiation shield 18 near opening 12. Thermal strut 17 is conductively coupled to a low temperature second stage or primary cryopanel array 26 having inner cryopanel surfaces 20 and outer cryopanel surfaces 24 which are conductively coupled together. The radiation shield 18 provides radiation shielding for the primary cryopanel array 26.

Frontal cryopanel array 14 includes a series of angled baffles 14*a*. The inner cryopanel surfaces 20 are centrally located within vacuum vessel 11 and extend between and above the outer cryopanel surfaces 24. The inner cryopanel surfaces 20 include a series of downwardly angled panels 20*a* having adsorbent material 21, preferably charcoal, adhered on the lower surfaces. Outer cryopanel surfaces 24 extend outwardly towards radiation shield 18 and then extend upwardly along radiation shield 18 close to the inner surface thereof. This leaves a relatively large gap 31 between the inner cryopanel surfaces 20 and the outer cryopanel surfaces 24. The gap 31 is about the same as the width W of the inner cryopanel surfaces 20 so that the distance between the outer cryopanel surfaces 24 is about 3 times the width W (3:1 ratio).

Cold finger 15*a* and thermal strut 15 cool radiation shield 18 and frontal cryopanel array 14 to the same temperature, typically between about 60 K to 140 K, with about 80 K being the most preferred. In addition, cold finger 17*a* and thermal strut 17 cool primary cryopanel array 26 preferably to a temperature between about 4 K to 25 K, with 14 K being the most preferred.

In operation, gases enter cryopump 10 from the process chamber through opening 12 and pass over frontal cryopanel array 14. Higher boiling point gases such as water vapor condense and freeze on the baffles 14*a* of frontal cryopanel array 14. Lower boiling point gases such as hydrogen and argon pass through frontal cryopanel array 14 and enter the interior 19 of vacuum vessel 11. Some of the lower boiling point gases such as argon entering the interior 19 of vacuum vessel 11 condense as frost 22 on the outer cryopanel surfaces 24 of primary cryopanel array 26. The condensed gases on the outer cryopanel surfaces 24 are restricted to regions near the radiation shield 18 and thus away from the inner cryopanel surfaces 20. This leaves open a large central gas flow pathway 29 which does not become blocked or significantly narrowed by condensing gases so subsequent low boiling point gases can flow through frontal cryopanel array 14 directly to the inner cryopanel surfaces 20. The majority of the low boiling point gases condensed on the inner cryopanel surfaces 20 are located on the top portion thereof. Since the inner cryopanel surfaces 20 extend above the outer cryopanel surfaces 24, the gases condensed as frost 22 on the top portion of the inner cryopanel surfaces 20 are substantially above the frost 22 on the outer cryopanel surfaces 24, thereby preventing substantial narrowing of gap 31. Consequently, the flow rate of gases towards outer cryopanel surfaces 24 and inner cryopanel surfaces 20 does not become significantly reduced during operation so that the pumping speed of low and very low boiling point gases remains relatively high.

In addition, the outer cryopanel surfaces 24 significantly limits the amount of low boiling point gases such as argon condensing on the inner cryopanel surfaces 20. As a result, the low boiling point gases which condense as frost 22 on the panels 20*a* of the inner cryopanel surfaces 20 are at levels low enough not to significantly impede flow to the adsorbent 21 on the lower surfaces of panels 20*a*, thereby maintaining a high hydrogen pumping speed.

Consequently, the primary cryopanel array 26 provides a large open gas flow pathway 29 to the inner 20 and outer 24 cryopanel surfaces while keeping the adsorbent 21 on the lower surfaces of panels 20*a* relatively clear so that the pumping speed of low boiling point gases such as argon as well as very low boiling point gases such as hydrogen remains high.

FIG. 3 depicts primary cryopanel array 26 in further detail. The frame of primary cryopanel array 26 has two halves formed from sheet metal which are each bent to form a bottom wall 24*a*, an upright wall 27 extending vertically upward at a right angle from bottom wall 24*a*, and an outwardly and upwardly extending outer cryopanel surface 24. Outer cryopanel surface 24 angles upwardly from bottom wall 24 and away from upright wall 27 before terminating in a section that is parallel to wall 27. The two halves are joined together by fastening the two upright walls 27 together with fasteners 28 such as rivets or bolts which also serve to mount angled panels 20*a* to the exposed sides of the joined upright walls 27. In the embodiment shown in FIG. 3, there are three angled panels on each exposed side of the upright walls 27. A series of holes 23 are formed in the bottom walls 24*a* for mounting primary cryopanel array 26 to thermal strut 17. The adsorbent 21 adhered to the bottom surfaces of panels 20*a* is preferably charcoal adhered with epoxy but alternatively can be a molecular sieve. Cryopanel 26 is preferably formed from sheets of conductive metal 0.030 inch thick such as copper but can be made of other suitable materials such as aluminum. In addition, cryopanel 26 can be soldered or welded together instead of being fastened together with fasteners 28.

Figure 4:
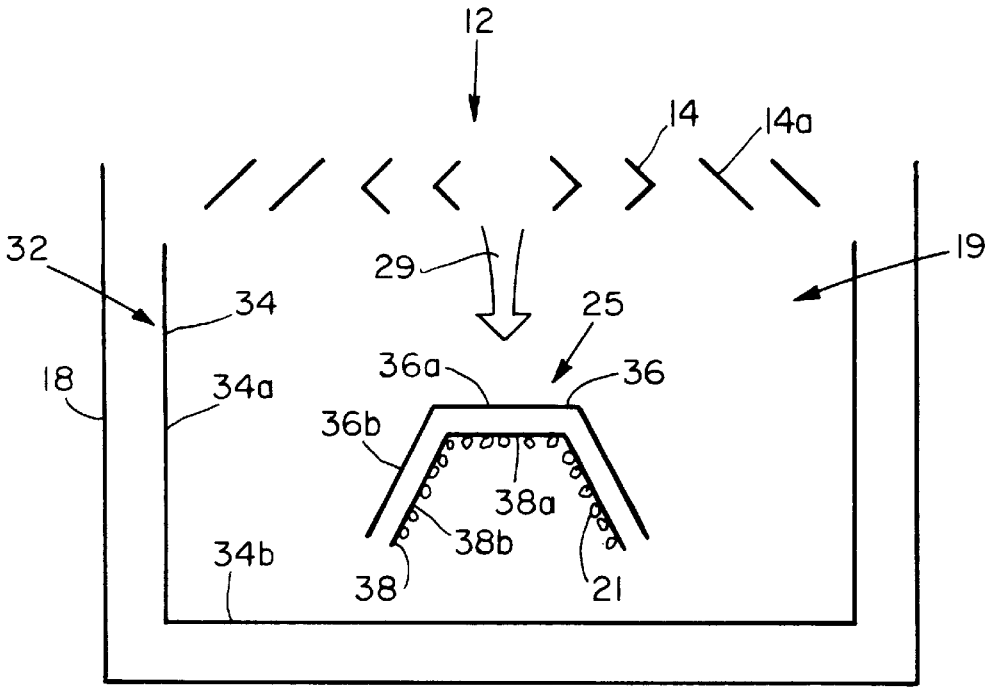
FIG. 4. is a schematic drawing of another preferred primary cryopanel array.

FIGS. 4–7 are schematic illustrations of further embodiments of the invention. FIG. 4 depicts another preferred primary cryopanel array arrangement. Primary cryopanel array 32 differs from primary cryopanel array 26 in that cryopanel array 32 is generally circular in shape. Cryopanel array 32 includes a cup-shaped outer panel 34 and an inner frusto-conical shaped panel unit 25 centrally positioned within outer panel 34. Outer panel 34 has an outer cylindrical wall 34*a* and a flat bottom wall 34*b*. Inner panel unit 25 includes an upper panel portion 36 and a lower panel portion 38. Upper panel portion 36 has an angled side wall 36*b* and a flat upper wall 36*a*. Lower panel portion 38 is positioned within upper panel portion 36 with a gap therebetween and also has an angled side wall 38*b* and a flat upper wall 38*a*. Adsorbent 21 is adhered to the interior surface of lower panel portion 38. The outer panel 34 and lower panel portion 38 are both cooled by cold finger 17*a* and thermal strut 17 preferably to a temperature of about 14 K to 20 K while upper panel portion 36 is cooled by cold finger 15*a* and thermal strut 15 preferably to a temperature of about 80 K. Lower boiling point gases such as argon condense on the walls 34*a* of outer panel 34 leaving open a large central gas flow pathway 29 to inner panel unit 25. As a result, very low boiling point gases such as hydrogen have relatively unobstructed access to the adsorbent 21 within inner panel unit 25 for adsorption. Upper panel portion 36 shields and prevents overloading of the adsorbent 21.

Figure 5:
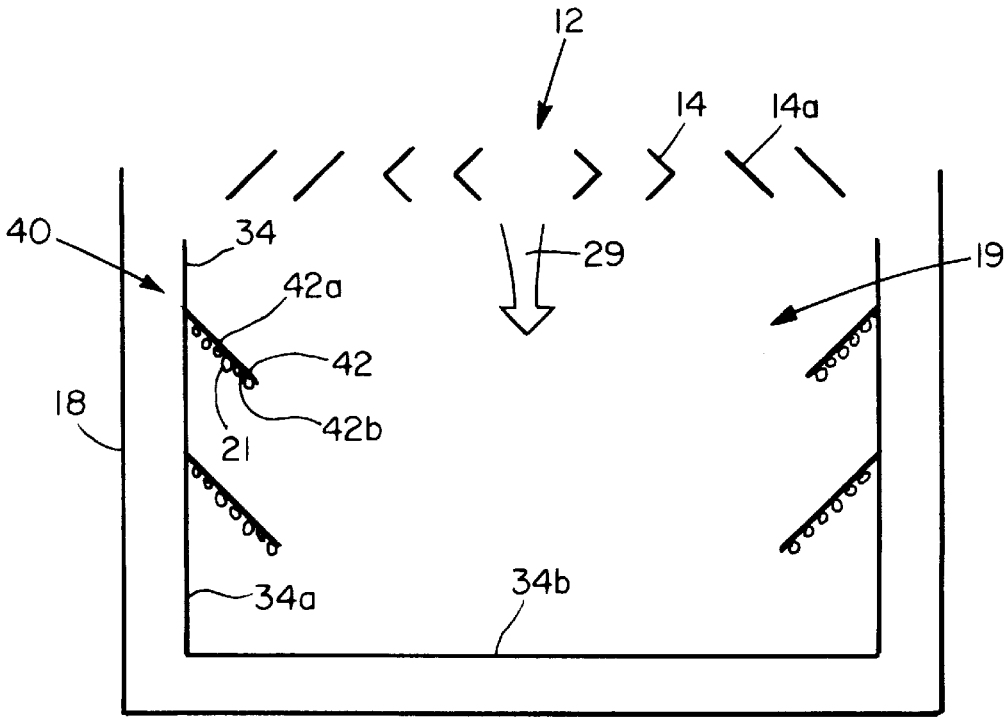
FIG. 5 is a schematic drawing of still another preferred primary cryopanel array.

Referring to FIG. 5, primary cryopanel array 40 is another preferred primary cryopanel array which differs from primary cryopanel array 32 in that a series of annular downwardly angled panels 42 are mounted to the interior surface of outer panel 34. Both panels 34 and 42 are cooled by cold finger 17*a* and thermal strut 17 preferably to a temperature of about 14 K to 20 K. The outer panel 34 and the upper surfaces 42*a* of panels 42 condense low boiling point gases such as argon thereon while the lower surfaces 42*b* of panels 42 include adsorbent 21 for adsorbing very low boiling point gases such as hydrogen. It can be seen in FIG. 5 that a large central gas flow pathway 29 remains open as gases are trapped by primary cryopanel array 40.

Figure 6:
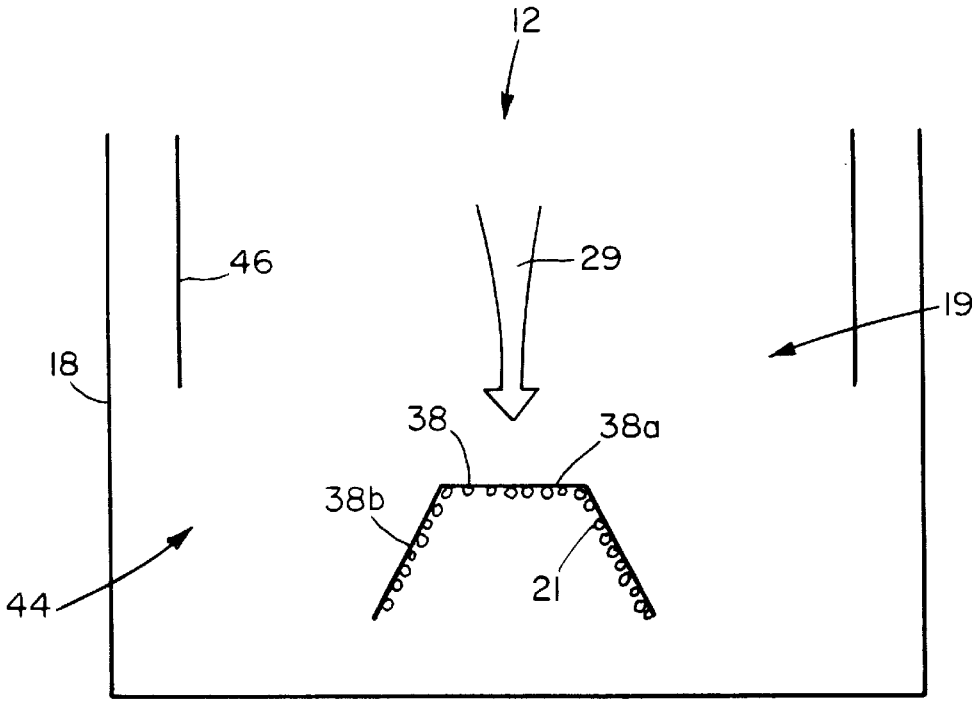
FIG. 6 is a schematic drawing of yet another preferred primary cryopanel array.

Referring to FIG. 6, primary cryopanel array 44 is another preferred primary cryopanel array which differs from primary cryopanel array 32 in that outer panel 34 is replaced by an optically open cylindrical outer panel 46 positioned above a lower panel portion 38. This allows a large amount of low boiling point gases such as argon to condense on outer panel 46 before reaching lower panel portion 38. Both outer panel 46 and lower panel portion 38 are cooled by cold finger 17*a* and thermal strut 17 preferably to a temperature of about 14 K to 20 K. Since outer panel 46 is positioned close to radiation shield 18, a large central gas flow pathway 29 remains open, thereby allowing very low boiling point gases such as hydrogen relatively unobstructed access to the adsorbent 21 located on the inner surface of lower panel portion 38.

Figure 7:
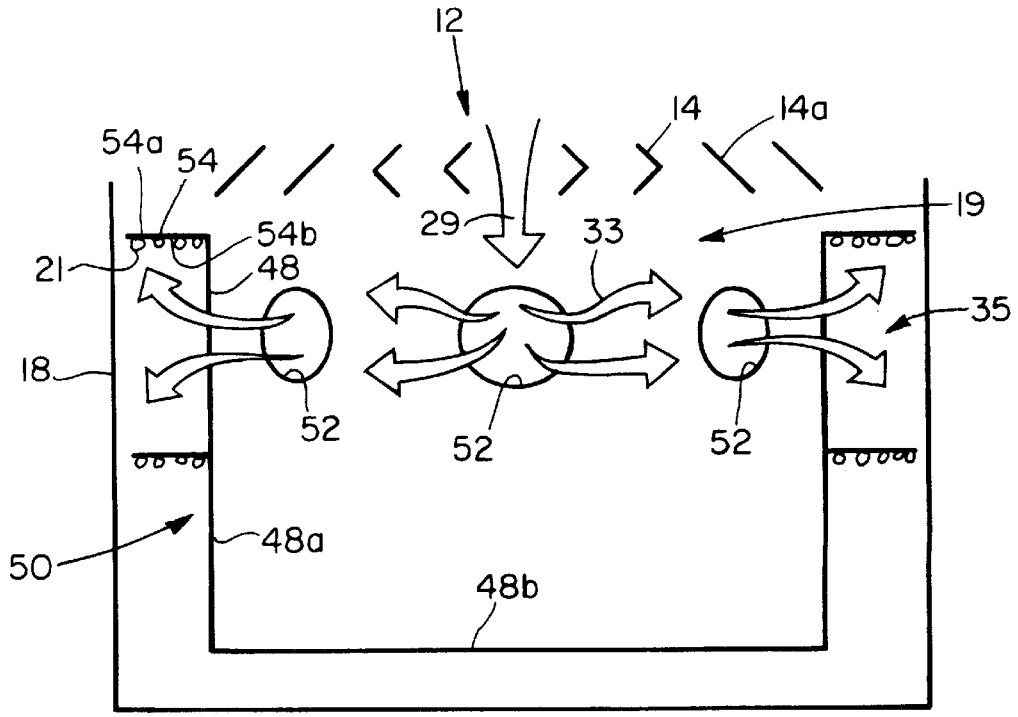
FIG. 7 is a schematic drawing of still another preferred primary cryopanel array.

Referring to FIG. 7, primary cryopanel array 50 is another preferred primary cryopanel array which differs from primary cryopanel array 40 in that a series of annular panels 54 are mounted to the exterior surface of a cup-shaped cylindrical panel 48. Panel 48 includes a cylindrical side wall 48*a* extending upwardly from a bottom wall 48*b*. A series of openings 52 through wall 48*a* extend around the perimeter of panel 48. Panel 48 is spaced a sufficient distance inwardly from radiation shield 18 to provide room for panels 54. Panels 54 are preferably perpendicular to the wall 48*a* of panel 48 but alternatively, can be angled downwardly. Panels 48 and 54 are cooled by cold finger 17*a* and thermal strut 17 preferably to a temperature of about 14 K to 20 K. Panels 54 include upper surfaces 54*a* for condensing low boiling point gases such as argon thereon and lower surfaces 54*b* having adsorbent 21 for adsorbing very low boiling point gases such as hydrogen. The openings 52 allow gases flowing along the central gas flow pathway 29 to flow outwardly through openings 52 into the annular gap 35 between panel 48 and radiation shield 18 as shown by arrows 33 to become trapped on panels 54.

While this invention has been particularly shown and described with references to preferred embodiments thereof, it will be understood by those skilled in the art that various changes in form and details may be made therein without departing from the spirit and scope of the invention as defined by the appended claims.

For example, although vacuum vessel 11 and primary cryopanel array 26 have been shown and described to have generally rectangular outer perimeters, alternatively, other suitable perimeter shapes can be employed such as circular or oval, etc. In addition, although primary cryopanel arrays 32, 40, 44 and 50 have been described to be generally circular about the perimeter, alternatively, the perimeter can be rectangular or be of other suitable shapes. Furthermore, the arrays do not have to be within vacuum vessel 11 but can be placed directly within the volume to be evacuated. Although terms such as upper, lower, side, top, vertical, upright, bottom, etc. have been used in describing the present invention, such terms describe the location of components relative to each other and are not meant to limit the present invention to a particular orientation.

What is claimed is:

1. A cryopump comprising:

a radiation shield having an interior surrounded by at least one wall, the radiation shield having an opening through which gases are cryopumped into the interior;

a frontal cryopanel array positioned near the opening for condensing high boiling point gases, the radiation shield and frontal cryopanel array being cooled to a first temperature;

first primary cryopanel surfaces extending near the wall within the interior of the radiation shield and cooled to a second temperature below the first temperature for condensing low boiling point gases near the wall of the radiation shield while leaving a central gas flow pathway from the opening past the first primary cryopanel surfaces; and second primary cryopanel surfaces positioned within the interior of the radiation shield and cooled to about the second temperature including adsorbent for adsorbing very low boiling point gases, the first primary cryopanel surfaces limiting the amount of low boiling point gases condensing on the second primary cryopanel surfaces while leaving open the central gas flow pathway to the second primary cryopanel surfaces.

2. The cryopump of claim 1 further comprising a vacuum vessel enclosing the radiation shield, frontal cryopanel array, and the first and second primary cryopanel surfaces.

3. The cryopump of claim 2 in which the first primary cryopanel surfaces substantially surround the second primary cryopanel surfaces.

4. The cryopump of claim 3 in which the second primary cryopanel surfaces includes panels which are angled away from the opening.

5. The cryopump of claim 4 in which the frontal cryopanel array and the radiation shield are cooled to about 60 K to 140 K, and the first and second primary cryopanel surfaces are cooled to about 25 K or less.

6. The cryopump of claim 4 in which the first and second primary cryopanel surfaces are conductively coupled together.

7. The cryopump of claim 1 in which the adsorbent faces away from the opening of the vacuum vessel.

8. The cryopump of claim 1 in which the first primary cryopanel surfaces are formed from a cylindrically shaped panel.

9. The cryopump of claim 8 in which the cylindrically panel is cup-shaped.

10. The cryopump of claim 9 in which the second primary cryopanel surfaces are formed from annularly shaped panels secured to the cylindrically shaped panel.

11. The cryopump of claim 8 in which the second primary cryopanel surfaces include a frusto-conical shaped panel.

12. A cryopanel array for use in a cryopump having a radiation shield with an interior surrounded by a wall, the radiation shield having an opening through which gases are cryopumped, a frontal cryopanel array positioned near the opening for condensing high boiling point gases, the radiation shield and frontal cryopanel array being cooled to a first temperature, the cryopanel array comprising:

first primary cryopanel surfaces for extending near the wall within the interior of the radiation shield and for cooling to a second temperature below the first temperature for condensing low boiling point gases near the wall while leaving a central gas flow pathway past the first primary cryopanel surfaces; and second primary cryopanel surfaces for positioning within the interior of the radiation shield and for cooling to about the second temperature including adsorbent for adsorbing very low boiling point gases, the first primary cryopanel surfaces for limiting the amount of low boiling point gases condensing on the second primary cryopanel surfaces while leaving open the central gas flow pathway to the second primary cryopanel surfaces.

13. The cryopump of claim 12 in which the adsorbent is positioned to face away from the opening of the vacuum vessel.

14. The cryopump of claim 12 in which the first primary cryopanel surfaces substantially surround the second primary cryopanel surfaces.

15. The cryopump of claim 14 in which the second primary cryopanel surfaces includes panels which are angled away from the opening.

16. The cryopump of claim 12 in which the first and second primary cryopanel surfaces are cooled to about 25 K or less.

17. The cryopump of claim 12 in which the first and second cryopanel surfaces are conductively coupled together.

18. The cryopump of claim 12 in which the first primary cryopanel surfaces are formed from a cylindrically shaped panel.

19. The cryopump of claim 18 in which the cylindrically shaped panel is cup-shaped.

20. The cryopump of claim 19 in which the second primary cryopanel surfaces are formed from annularly shaped panels secured to the cylindrically shaped panel.

21. The cryopump of claim 18 in which the second primary cryopanel surfaces include a frusto-conical shaped panel.

22. A cryopump comprising:

a radiation shield having an interior surrounded by at least one wall, the radiation shield being cooled to a first temperature and having an opening through which gases are cryopumped into the interior;

first primary cryopanel surfaces extending near the wall within the interior of the radiation shield and cooled to a second temperature below the first temperature for condensing low boiling point gases near the wall of the radiation shield while leaving a central gas flow pathway from the opening past the first primary cryopanel surfaces; and second primary cryopanel surfaces positioned within the interior of the radiation shield and cooled to about the second temperature including adsorbent for adsorbing very low boiling point gases, the first primary cryopanel surfaces limiting the amount of low boiling point gases condensing on the second primary cryopanel surfaces while leaving open the central gas flow pathway to the second primary cryopanel surfaces.

23. A method of cryopumping gases with a cryopump, the cryopump including a radiation shield having an interior surrounded by at least one wall, the radiation shield having an opening through which gases are cryopumped, the method comprising the steps of:

condensing high boiling point gases on a frontal cryopanel array positioned near the opening, the radiation shield and frontal cryopanel array being cooled to a first temperature;

condensing low boiling point gases on first primary cryopanel surfaces extending near the wall within the interior of the radiation shield while leaving a central gas flow pathway from the opening past the first primary cryopanel surfaces, the first primary cryopanel surfaces being cooled to a second temperature below the first temperature; and adsorbing very low boiling point gases with adsorbent located on second primary cryopanel surfaces, the second primary cryopanel surfaces being cooled to about the second temperature, the first cryopanel surfaces limiting the amount of low boiling point gases condensing on the second primary cryopanel surfaces while leaving open the central gas flow pathway to the second primary cryopanel surfaces.

24. The method of claim 23 further comprising the step of enclosing the radiation shield, frontal cryopanel array, and the first and second primary cryopanel surfaces within a vacuum vessel.

25. The method of claim 24 further comprising the step substantially surrounding the second primary cryopanel surfaces with the first primary cryopanel surfaces.

26. The method of claim 24 further comprising the steps of:

cooling the frontal cryopanel array and the radiation shield to about 60 K to 140 K; and cooling the first and second primary cryopanel surfaces to between about 25 K or less.

27. The method of claim 23 further comprising the step of conductively coupling the first and second primary cryopanel surfaces together.

28. A method of cryopumping gases with a cryopump, the cryopump including a radiation shield having an interior surrounded by at least one wall, the radiation shield being cooled to a first temperature and having an opening through which gases are cryopumped, the method comprising the steps of:

condensing low boiling point gases on first primary cryopanel surfaces extending near the wall within the interior of the radiation shield while leaving a central gas flow pathway from the opening past the first primary cryopanel surfaces, the first primary cryopanel surfaces being cooled to a second temperature below the first temperature; and adsorbing very low boiling point gases with adsorbent located on second primary cryopanel surfaces, the second primary cryopanel surfaces being cooled to about the second temperature, the first cryopanel surfaces limiting the amount of low boiling point gases condensing on the second primary cryopanel surfaces while leaving open the central gas flow pathway to the second primary cryopanel surfaces.

* * * * *